US007207496B2

(12) United States Patent
Alles

(10) Patent No.: US 7,207,496 B2
(45) Date of Patent: Apr. 24, 2007

(54) VENT-BLOCKING INFLATABLE BLADDER FOR A RETROFIT HVAC ZONE CONTROL SYSTEM

(75) Inventor: Harold Gene Alles, Lake Oswego, OR (US)

(73) Assignee: Home Comfort Zones, Inc., Beaverton, OR (US)

( * ) Notice: Subject to any disclaimer, the term of this patent is extended or adjusted under 35 U.S.C. 154(b) by 109 days.

(21) Appl. No.: 10/750,467

(22) Filed: Dec. 31, 2003

(65) Prior Publication Data

US 2004/0182096 A1 Sep. 23, 2004

Related U.S. Application Data

(63) Continuation-in-part of application No. 10/249,198, filed on Mar. 21, 2003.

(51) Int. Cl.
*F23N 5/20* (2006.01)
*F24F 7/00* (2006.01)
*F25D 17/04* (2006.01)

(52) U.S. Cl. ..... 236/46 R; 236/49.4; 62/186; 62/178

(58) Field of Classification Search ..... 236/46 R, 236/49.4; 62/186, 178; 165/217
See application file for complete search history.

(56) References Cited

U.S. PATENT DOCUMENTS 2,008,431 A * 7/1935 Aitken ..... 55/376
3,976,245 A * 8/1976 Cole ..... 236/93 A
4,545,524 A * 10/1985 Zelczer ..... 236/46 R

* cited by examiner

*Primary Examiner*—Chen Wen Jiang
(74) *Attorney, Agent, or Firm*—Blakely, Sokoloff, Taylor & Zafman

(57) ABSTRACT

An improved inflatable bladder for use as a zone climate control system valve to controllably permit and prevent airflow through a vent of a forced air HVAC system. The bladder is secured by a rigid strap which may be coupled to the vent near the vent opening. The bladder is coupled to its pressure/vacuum air tube by a pin which is inserted through the air tube and the bladder nipple to which it mates. The bladder may have a donut shape for use with a vent which is located directly on a trunk which also has downstream vents or ducts which are not part of the same zone as the vent controlled by the bladder.

8 Claims, 11 Drawing Sheets

FIG. 4
FIG. 4A
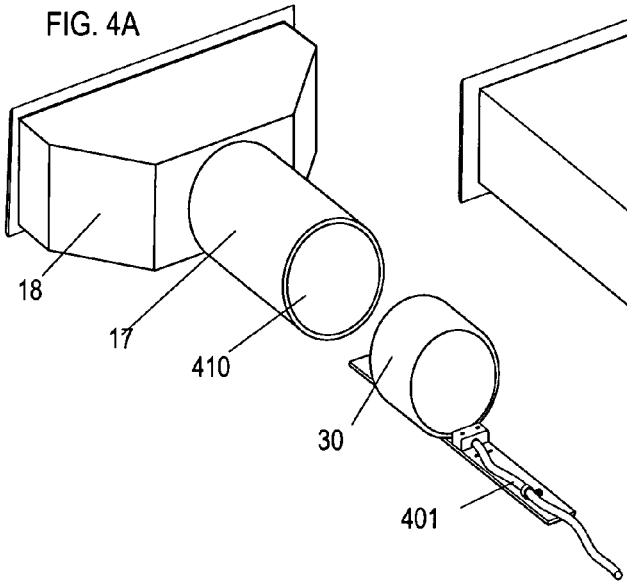
FIG. 4B
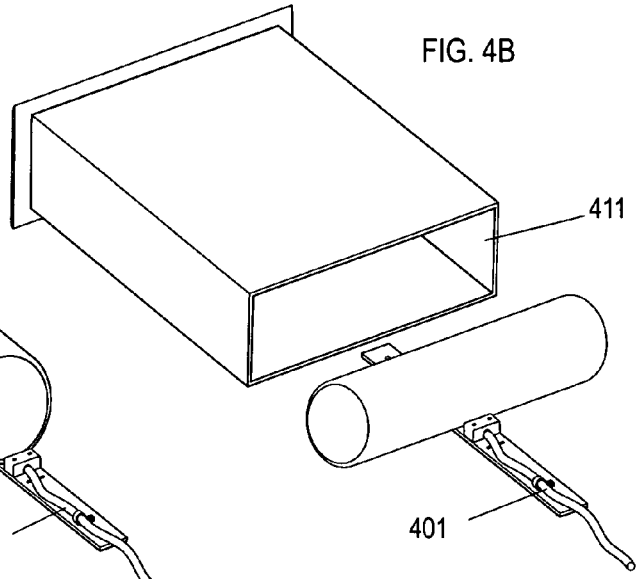
FIG. 4C
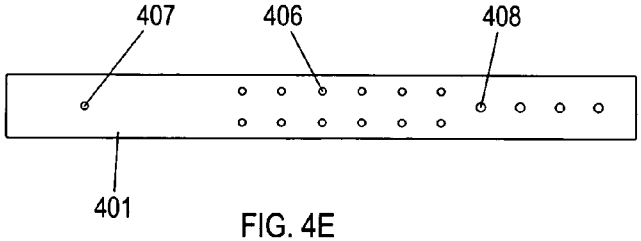
FIG. 4D
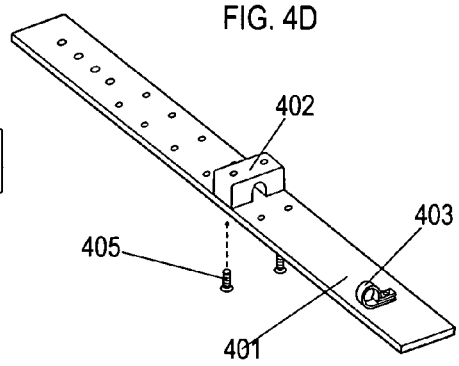
FIG. 4E
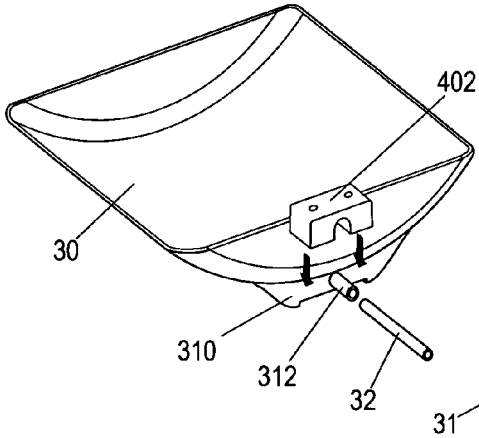
FIG. 4F
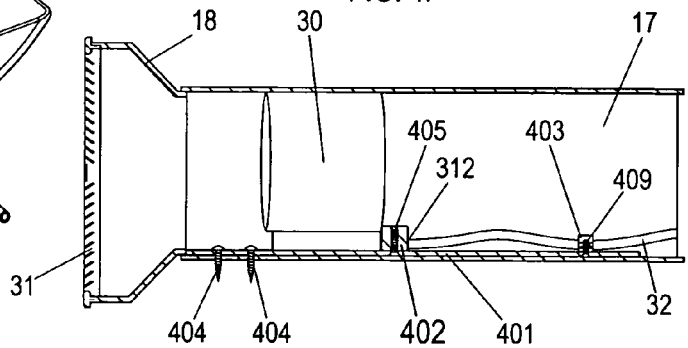

Docket: HCZ006

Fig. 14
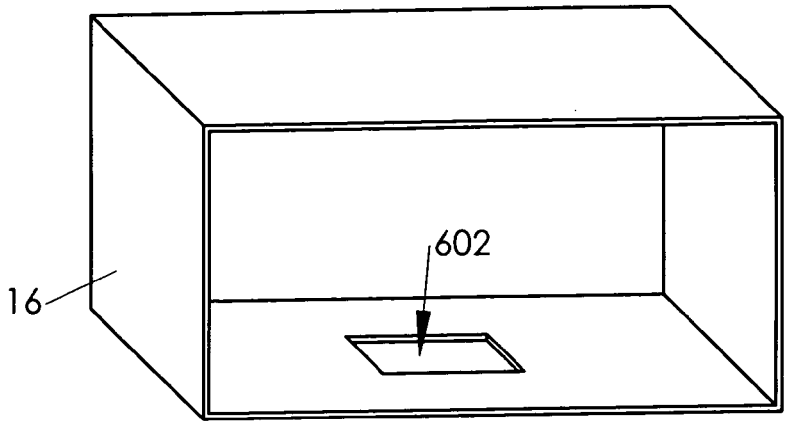
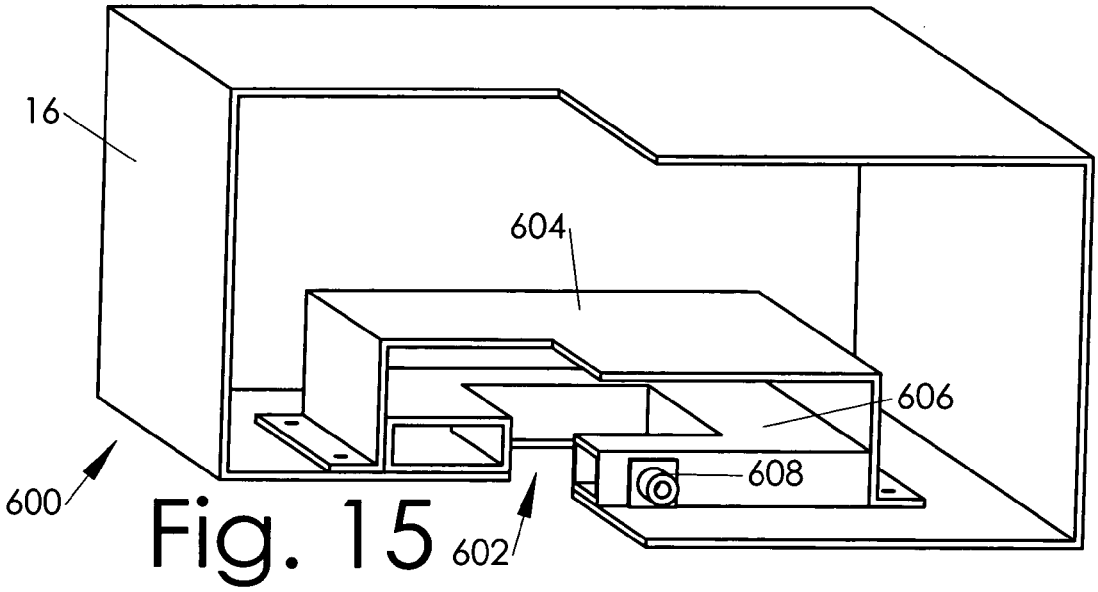
Fig. 15
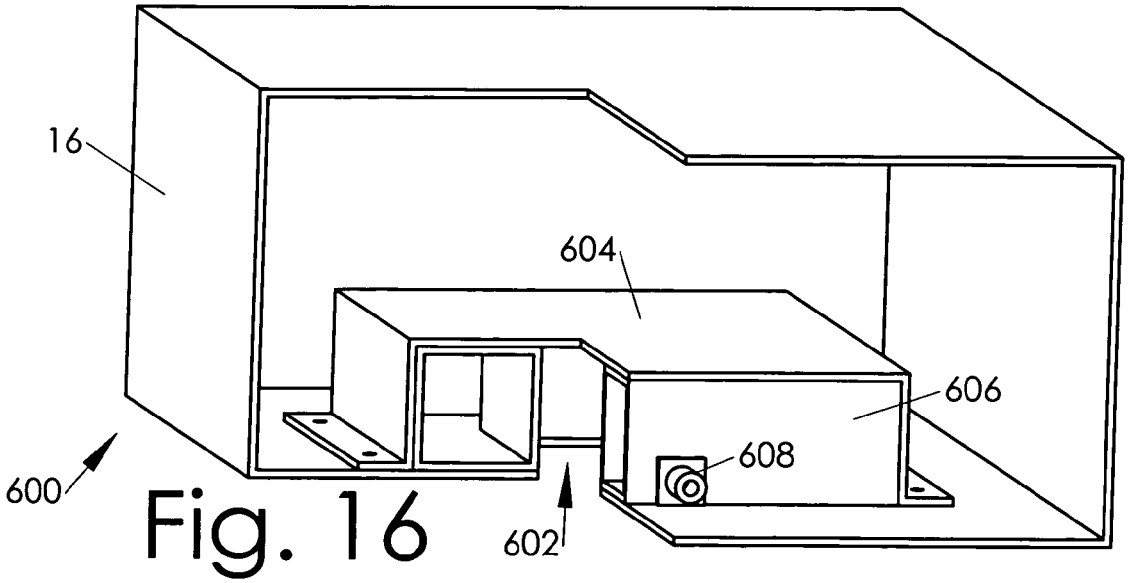
Fig. 16

640

670

VENT-BLOCKING INFLATABLE BLADDER FOR A RETROFIT HVAC ZONE CONTROL SYSTEM

RELATED APPLICATIONS

This application is a continuation-in-part, and claims filing date benefit, of application Ser. No. 10/249,198 entitled "An Improved Forced-Air Climate Control System for Existing Residential House" filed Mar. 21, 2003 by this inventor.

BACKGROUND OF THE INVENTION

1. Technical Field of the Invention

This invention relates generally to dampers for controllably closing and opening air circulation vents in an HVAC system, and more specifically to an inflatable bladder for insertion inside a vent or a duct.

2. Background Art

U.S. Pat. No. 5,348,078 issued Sep. 30, 1994 and U.S. Pat. No. 5,449,319 issued Sep. 12, 1995 to Dushane et. al describe a retrofit room-by-room zone control system for residential forced air HVAC systems that uses complex electrically activated airflow control devices at each air vent. The devices are mechanically complex, each with a radio receiver, servo motor, and multiple mechanical louvers. The devices are powered by batteries that are recharged by a generator powered by airflow through the air vent. Another embodiment is described that uses wires connected to a central control unit to control the airflow control devices, adding complexity to the installation process. The airflow control devices replace the existing air grills, so the installation is visible, and multiple sizes and shapes of airflow control devices are needed to accommodate the variety of air vents found in houses. The devices are expensive and have no shared mechanisms for control or activation to reduce the cost of the multiple devices required. The preferred embodiment uses household power wiring for communications between the thermostats and the central control, requiring visible wires from a power outlet to the thermostat. A cited advantage of the system is it does not have sensors inside the ducts, so the system cannot make control decisions based on plenum pressure or plenum temperature, therefore excessive noise and temperatures may occur for some settings of the airflow control devices. The thermostats and common controller have complex interfaces with limited functionality, making the system difficult to use.

U.S. Pat. No. 5,704,545 issued Jan. 6, 1998 to Sweitzer describes another zone system where the airflow control devices are louvers actuated by a local electromechanical mechanism. This invention requires modification to the air ducts and connecting wires from the airflow control devices to the common controlling device. This system is expensive and difficult to retrofit.

U.S. Pat. No. 4,545,524 issued Oct. 8, 1985, U.S. Pat. No. 4,600,144 issued Jul. 15, 1986, U.S. Pat. No. 4,742,956 issued May 10, 1988, and U.S. Pat. No. 5,170,986 issued Dec. 15, 1992 to Zelczer, et al. describe a variety of inflatable bladders used as airflow control devices in air ducts. All of these are adapted for mounting in a way that requires access to the air ducts for cutting holes and inserting devices into the duct, and for the controlling air tube to pass from the inside of the air duct to the outside of the duct for passage to the device that provides the air for the bladders. These airflow control devices do not provide a way for non-intrusive installation.

U.S. Pat. No. 4,522,116 issued Jun. 11, 1985, U.S. Pat. No. 4,662,269 issued May 5, 1987, U.S. Pat. No. 4,783,045 issued Nov. 8, 1988, and U.S. Pat. No. 5,016,856 issued May 21, 1991 to Tartaglino describe a series of inflatable bladders of different shapes and control methods. The disclosed control methods relate to the air pressure and vacuum used to inflated and deflate the bladders. The bladder shapes are novel but different from those used in the present invention.

U.S. Pat. No. 5,234,374 issued Aug. 10, 1993 to Hyzyk, et al. describes an inflatable bladder used as an airflow control device installed inside an air duct at an air vent. The bladder is inflated by a small blower also mounted in the air vent and powered by a battery. It receives control signals from a separate thermostat located in the room. This devices uses substantial power and battery life is limited. Since the blower for inflating the bladder is located at the air vent, noise from the blower is a problem which the inventor provides a muffler to help control. Each bladder is an independent unit and there is no sharing of components for controlling or powering, so there are no savings when many airflow devices are used in a zone control system. The device does provide a practical solution for providing centrally controllable airflow devices for each air vent in a house.

U.S. Pat. No. 5,772,501 issued Jun. 30, 1998 to Merry, et al. describes a system for selectively circulating unconditioned air for a predetermined time to provide fresh air. The system uses conventional airflow control devices installed in the air ducts and the system does not use temperature difference to control circulation. This system is difficult to retrofit and does not exploit selective circulation to equalize temperatures.

BRIEF DESCRIPTION OF THE DRAWINGS

The invention will be understood more fully from the detailed description given below and from the accompanying drawings of embodiments of the invention which, however, should not be taken to limit the invention to the specific embodiments described, but are for explanation and understanding only.

FIG. 4 shows installation of the air bladder into a duct of the HVAC system.

FIG. 14 shows a duct or trunk with a vent hole in its middle rather than at its end.

FIGS. 15 and 16 show a bladder system according to another embodiment of this invention, in a deflated condition and an inflated condition, respectively.

DETAILED DESCRIPTION

Forced Air Central HVAC System

Figure 1:
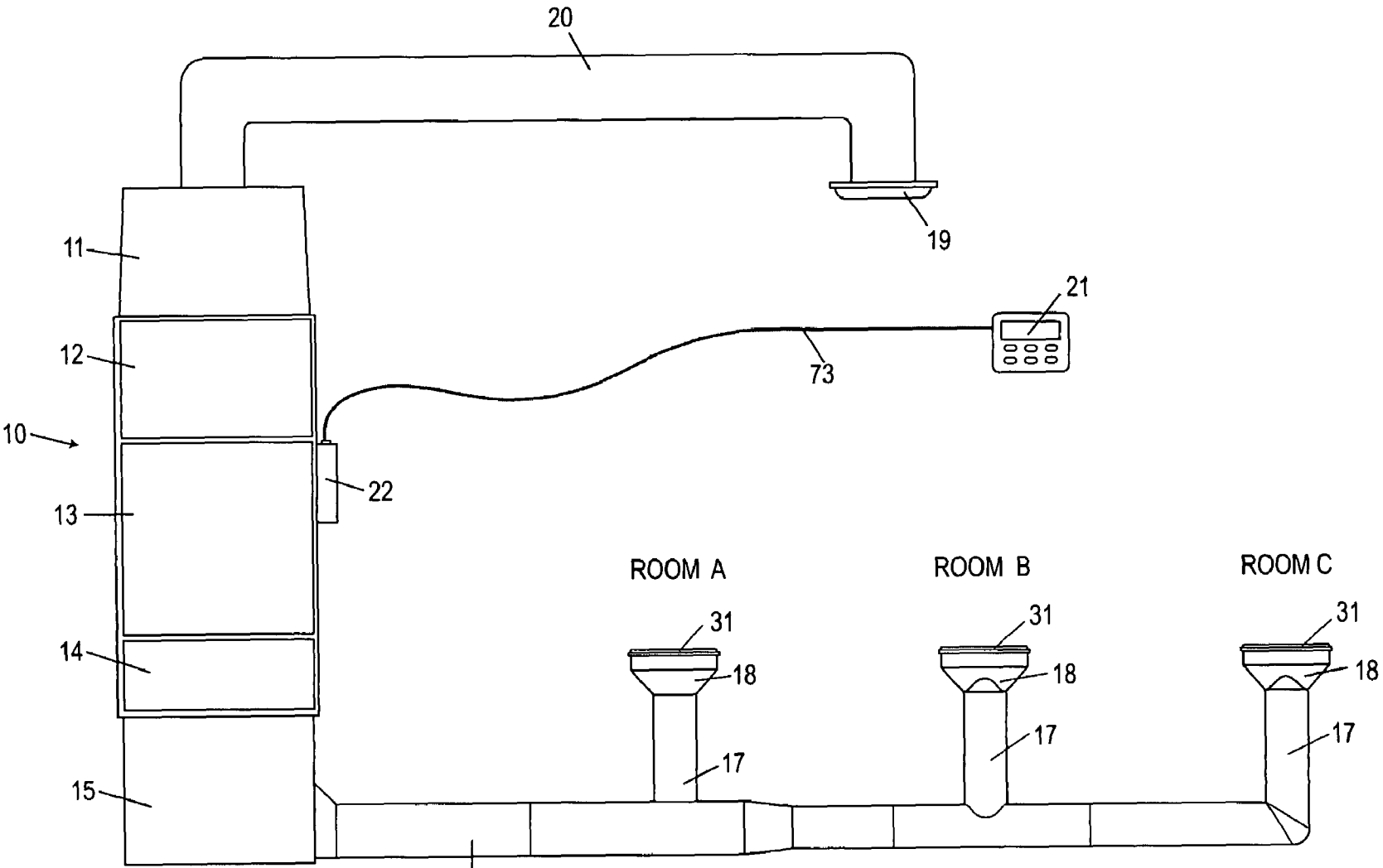
Fig. 1 prior art
FIG. 1 shows a conventional residential forced-air HVAC system.

FIG. 1 is a block diagram of a typical forced air system. The existing central HVAC unit 10 is typically comprised of a return air plenum 11, a blower 12, a furnace 13, an optional heat exchanger for air conditioning 14, and a conditioned air plenum 15. The configuration shown is called "down flow" because the air flows down. Other possible configurations include "up flow" and "horizontal flow". A network of air duct trunks 16 and air duct branches 17 connect from the conditioned air plenum 15 to each air vent 18 in room A, room B, and room C. Each air vent is covered by an air grill 31. Although only three rooms are represented in FIG. 1, the invention is designed for larger houses with many rooms and at least one air vent in each room. The conditioned air forced into each room is typically returned to the central HVAC unit 10 through one or more common return air vents 19 located in central areas. Air flows through the air return duct 20 into the return plenum 11.

The existing thermostat 21 is connected by a multi-conductor cable 73 to the existing HVAC controller 22 that switches power to the blower, furnace and air conditioner. The existing thermostat 21 commands the blower and furnace or blower and air conditioner to provide conditioned air to cause the temperature at thermostat to move toward the temperature set at the existing thermostat 21.

FIG. 1 is only representative of many possible configurations of forced air HVAC systems found in existing houses. For example, the air conditioner can be replaced by a heat pump that can provide both heating and cooling, eliminating the furnace. In some climates, a heat pump is used in combination with a furnace. The present invention can accommodate the different configurations found in most existing houses.

Retrofit Zone Control System

Figure 2:
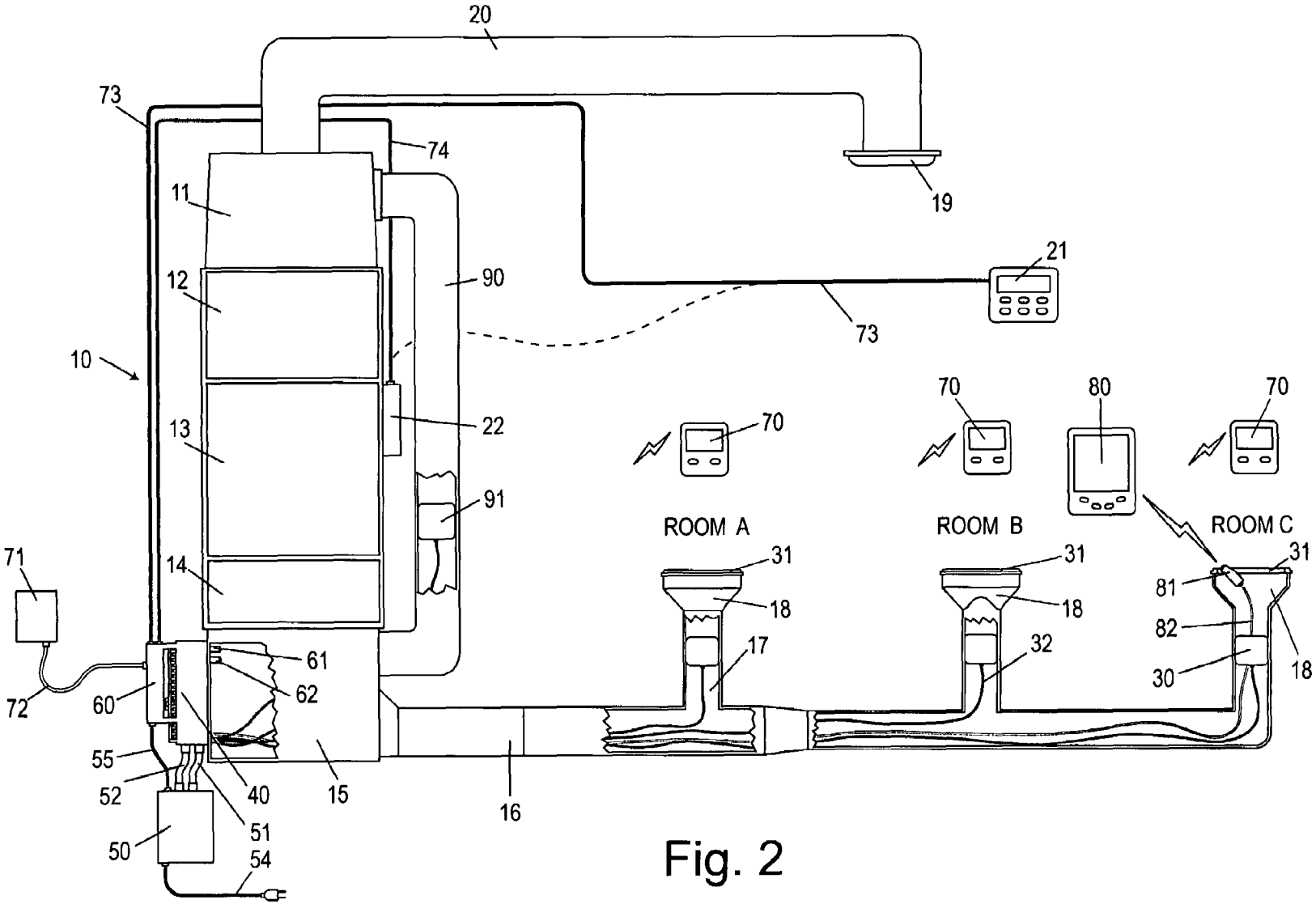
FIG. 2 shows the retrofit zone control system as retrofitted into the HVAC system.

FIG. 2 is a block diagram of the present invention installed in an existing forced air HVAC system as shown in FIG. 1. The airflow through each vent is controlled by a substantially airtight bladder 30 mounted behind the air grill 31 covering the air vent 18. The bladder is, ideally, either fully inflated or fully deflated while the blower 12 is forcing air through the air duct 17. A small air tube 32 (~0.25" OD) is pulled through the existing air ducts to connect each bladder to one air valve of a plurality of servo controlled air valves 40. In one embodiment, the air valves are mounted on the side of the conditioned air plenum 15. There is one air valve for each bladder, or, in some embodiments, one air valve for each set of commonly-acting bladders (such as, for example, if there are multiple vents in a single room).

A small air pump in air pump enclosure 50 provides a source of low-pressure (~1 psi) compressed air and vacuum at a rate of e.g. ~1.5 cubic feet per minute. The pressure air tube 51 connects the pressurized air to the air valves 40. The vacuum air tube 52 connects the vacuum to the air valves. The air pump enclosure also contains a low voltage (typically 5 or 12 volts) power supply and control circuit for the air pump. The AC power cord 54 connects the system to 110V AC power. The power and control cable 55 connect the low voltage power supply to the control processor and servo controlled air valves and connect the control processor 60 to the circuit that controls the air pump. The control processor controls the air valve servos to set each air valve to one of two positions. The first position connects the compressed air to the air tube so that the bladder inflates. The second position connects the vacuum to the air tube so that the bladder deflates.

A wireless thermometer 70 is placed in each room in the house. All thermometers transmit, on a shared radio frequency of 418 MHz, packets of digital information that encode 32-bit digital messages. A digital message includes a unique thermometer identification number, the temperature, and command data. Two or more thermometers can transmit at the same time, causing errors in the data. To detect errors, the 32-bit digital message is encoded twice in the packet. The radio receiver 71 decodes the messages from all the thermometers, discards packets that have errors, and generates messages that are communicated by serial data link 72 to the control processor. The radio receiver can be located away from the shielding effects of the HVAC equipment if necessary, to ensure reception from all thermometers.

The control processor is connected to the existing HVAC controller 22 by the existing HVAC controller connection 74. The existing thermostat 21 is replaced by a graphical display 80 with a touch sensitive screen. The graphical display is connected to the processor using the same wires that had been used by the existing thermostat. Therefore, no new wires need be installed through the walls. The program executing in the processor controls the graphical display and touch screen to provide the occupant a convenient way to program the temperature schedules for the rooms and to display useful information about energy usage and the operation of the HVAC system.

The control processor controls the HVAC equipment and the airflow to each room according to the temperature reported for each room and according to an independent temperature schedule for each room. The temperature schedules specify a heat-when-below-temperature and a cool-when-above-temperature for each minute of a 24-hour day. A different temperature schedule can be specified for each day for each room.

The present invention can set the bladders so that all of the airflow goes to a single air vent, thereby conditioning the air in a single room. This could cause excessive air velocity and noise at the air vent and possibly damage the HVAC equipment. This is solved by connecting a bypass air duct 90 between the conditioned air plenum 15 and the return air plenum 11. A bladder 91 is installed in the bypass 90 and its air tube is connected to an air valve 40 so that the control processor can enable or disable the bypass. The bypass provides a path for the excess airflow and storage for conditioned air. The control processor is interfaced to a temperature sensor 61 located inside the conditioned air plenum. The control processor monitors the conditioned air temperature to ensure that the temperature in the plenum does not go above a preset temperature when heating or below a preset temperature when cooling, and ensures that the blower continues to run until all of the heating or cooling has been transferred to the rooms. This is important when bypass is used and only a portion of the heating or cooling capacity is needed, so the furnace or air conditioner is turned only for a short time. Some existing HVAC equipment has two or more heating or cooling speeds or capacities. When present, the control processor controls the speed control and selects the speed based on the number of air vents open. This capability can eliminate the need for the bypass.

A pressure sensor 62 is mounted inside the conditioned air plenum and interfaced to the control processor. The plenum pressure as a function of different bladder settings is used to deduce the airflow capacity of each air vent in the system and to predict the plenum pressure for any combination of air valve settings. The airflow to each room and the time spent heating or cooling each room is use to provide a relative measure of the energy used to condition each room. This information is reported to the house occupants via the graphical display screen.

This brief description of the components of the present invention installed in an existing residential HVAC system provides an understanding of how independent temperature schedules are applied to each room in the house, and the improvements provided by the present invention. The following discloses the details of each of the components and how the components work together to proved the claimed features.

Airflow Control Bladder

Figure 3:
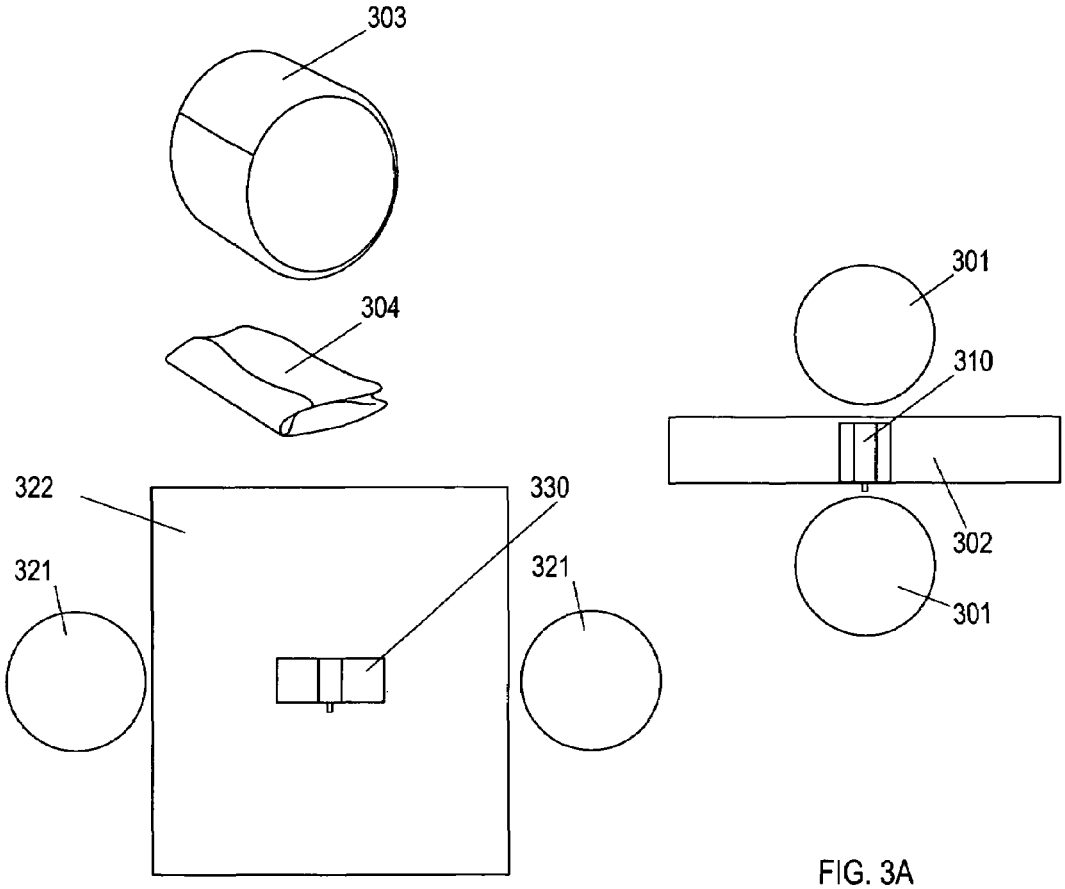
FIG. 3 shows an inflatable air bladder which is used as an airflow control device in the retrofit zone control system.
Figure 3A:
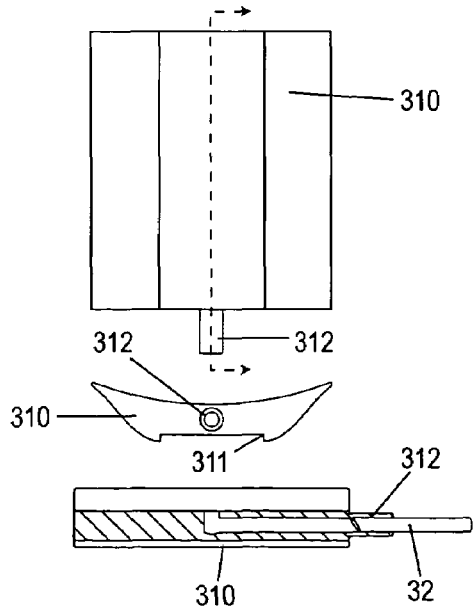

FIG. 3 is a diagram showing the construction of the bladders 30 used as airflow control devices. The bladders are constructed of flexible thin plastic (typically 0.01" thick) or fabric coated with an airtight flexible sealer. The material is approved by UL or another listing agency for use in plenums. The bladders for controlling airflow in round air ducts are cylinders made by seaming together two circular shapes 301 and a rectangular shape 302. Depending on the material, the airtight seams are heat sealed or glued. The material is only slightly elastic so the inflated size is determined by the dimensions of these shapes. An air tube connector 310 is sealed to the rectangular shape 302. The air tube connector is molded from flexible plastic approved for use in plenums. FIG. 3A shows more detail of the air tube connector, which has an air tube socket 312 sized so that it tightly grips the outside of the air tube 32. The air tube connector provides the air path from the air tube to the inside of the bladder. The air tube connector is contoured to match the curvature of the round air duct and has a notch 311 to fit a mounting strap. This shape prevents conditioned air from leaking around the bladder when it is inflated. The inflated bladder 303 is about 110% the diameter of the air duct and its height is about 75% of the diameter. When inflated in the duct, the cylinder wall is pressed firmly against the inside of the air duct, effectively blocking all airflow. The deflated bladder 304 presents a small cross-section to airflow and restricts airflow by less than 10%. The standard round duct sizes connecting to air vents in residential installations are 4", 6", and 8". Bypass 90 can be 6", 8", or 10" in diameter. A total of only 4 different round duct bladder sizes are needed for residential installations.

Figure 3B:
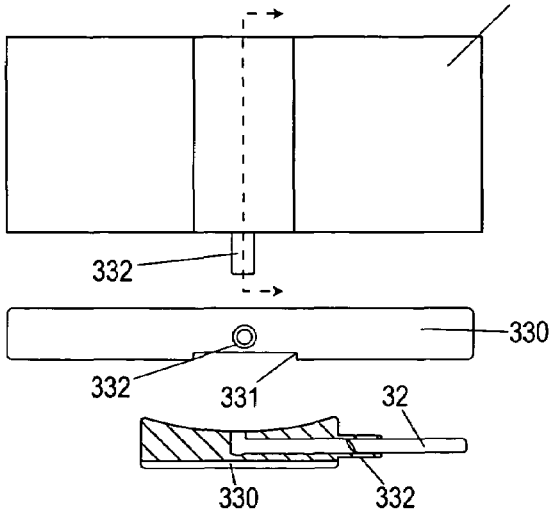

The bladders for controlling airflow in rectangular ducts are also cylinders made by seaming together two circular shapes 321 and a rectangular shape 322. The cylinder is oriented so that the axis of the cylinder is parallel to the widest dimension of the duct. The height of the cylinder is about 110% of the wider dimension of the duct. The cylinder diameter is at least 110% of the narrower dimension of the duct, but can be as much as 200%. When inflated, the bladder accepts only enough air to fill the air duct. FIG. 3B shows more detail of the air tube connector 330, which is contoured for the flat surface of the rectangular duct and it has a notch 331 to fit a mounting strap and air tube socket 332 sized to fit the outside of the air tube 32.

FIG. 4 shows several views of the method for mounting the bladder 30 in an air duct 17 at an air vent 18 covered by air grill 31. Referring to FIG. 4E, the air tube 32 is inserted into the air tube socket 312 in the air tube connector 310 sealed to the bladder 30 shown with the top portion cut away. Mounting clamp 402 compresses the air tube socket around the air tube.

FIG. 4C is a plain view of the mounting strap, which is made from thin metal (18 gauge) and is approximately 1" by 12". Hole 407 is used to secure the air tube to the mounting strap. One pair of holes 406 are used to secure the mounting clamp 402 to the mounting strap. Two of the holes 408 are used to secure the mounting strap to the inside of the air vent or air duct at the air vent.

FIG. 4D is a perspective drawing showing the mounting clamp 402 connecting to the mounting strap 401. The mounting clamp straddles the air tube socket 312 (shown in FIG. 4E) and two bladder clamp screws 405 pass through holes 406 in the mounting strap and screw into the mounting clamp. Several pairs of holes 406 (shown in FIG. 4C) are provided so the bladder can be positioned for the most effective seal of the air duct. The screws 405 are self-tapping with flat heads that match counter-sinks pressed into the holes 406 in the mounting strap. Tightening the bladder clamp screws 405 cause the bladder clamp 402 to compress the air tube socket 312 firmly around the air tube 32, securing the bladder to the mounting strap and ensuring an air tight seal between the air tube and the bladder. When tightened, the screw heads are flat with the bottom surface of the mounting strap, and the mounting strap fits in the notch 311 of the air tube connector 310 so the mounting strap is flat with the air tube connector.

FIG. 4F is a cross-section view of the assembled bladder installed in an air duct 17 connecting to air vent 18 covered by air grill 31. The air tube 32 is secured to the mounting strap 401 by the air tube clamp 403 (also shown in FIG. 4D) using a screw 409 and nut through hole 407 (shown in FIG. 4C). The air tube clamp transfers any tension on the air tube to the mounting strap and prevents strain on the connection between the air tube and the bladder. The mounting clamp 402 is connected to the mounting strap by two screws 405 and compresses the air tube socket 312 and secures the bladder 30 to the mounting strap. The mounting strap is secured to the inside of the air duct or air vent by two screws 404 through holes 408 (shown in FIG. 4C). Some air vents are constructed with in integrated section of air duct several inched long, which fits inside the connecting air duct 17. The inflated bladder can make contact with this extension of the air vent or it can make contact in the air duct when the extension is not part of the air vent.

FIG. 4A is an exploded perspective view of the assembled bladder 30 and mounting strap 401 fitting into the air duct 17 connected to air vent 18. The inside of the air duct or air vent 410 where the bladder makes contact must be a smooth surface. If sharp sheet metal edges or screws are present, they are cut or smoothed and covered with duct mastic or duct tape to form a smooth surface and contour.

FIG. 4B is an exploded perspective view of an assembled bladder and air tube secured to amounting strap 401 for mounting inside a rectangular air duct 411.

All installation and assembly work is done in the room where the air vent is located. The air grill is removed and an air tube 32 is pulled from the air vent to the plenum 15. The air tube is secured to the mounting strap 401 and the proper size and shape bladder 30 is secured to the mounting strap. The inside surface 410 of the air vent or air duct is prepared by smoothing, cutting, or covering sharp edges and screws. In many cases, no preparation is required. This surface is chosen so it is close enough to the front of the air vent to provide convenient access for any surface preparation work. The mounting strap is inserted into the air vent and the mounting strap is bent and position so the inflated bladder meets the surface 410. The mounting strap is then secured to the inside of the air vent by one or two sheet metal screws. The air grill is then reinstalled. After installation, the bladder is hidden by the air grill, and there are no visible signs of installation. The installation requires no other modification to the air duct, air vent, or air grill, and no other access to the air duct is required.

New Matter

Figure 5:
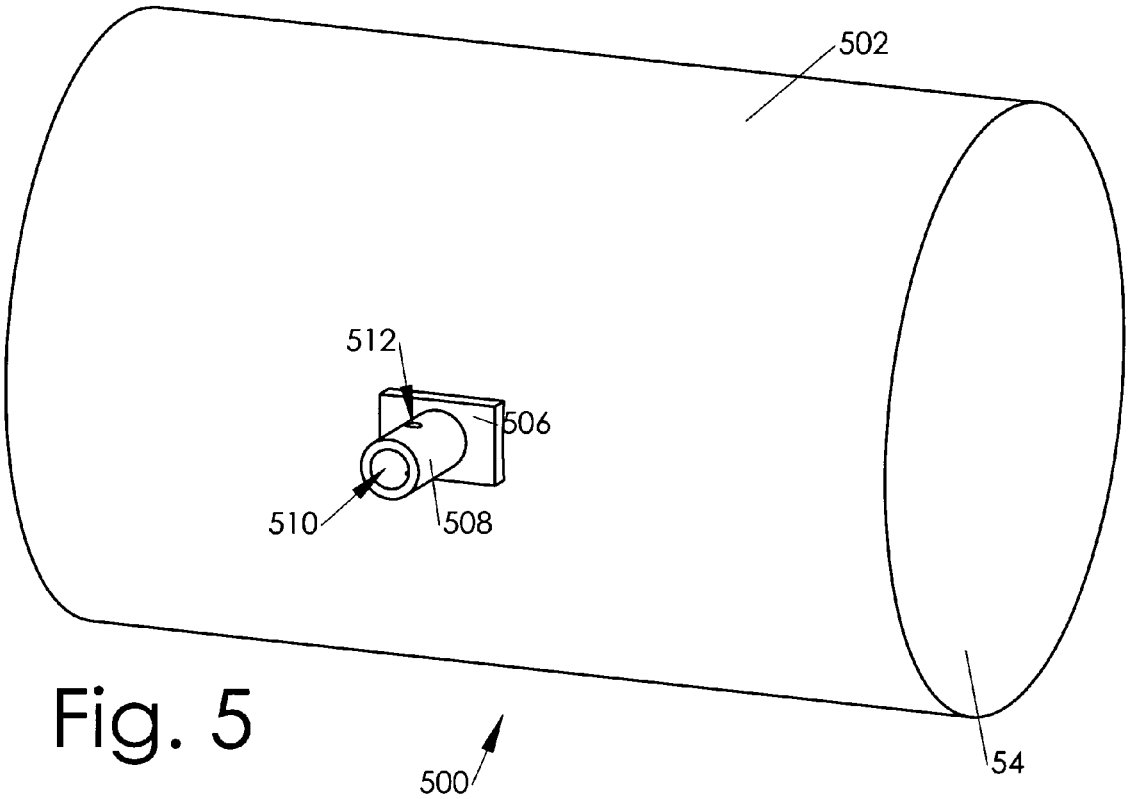
FIGS. 5 and 6 show an air bladder according to another embodiment of the invention, in inflated and deflated configurations, respectively.

FIG. 5 illustrates a bladder 500 according to another embodiment of this invention. The bladder includes a generally cylindrical tube 502 and generally round ends 504. A nipple support block 506 is coupled to the bladder, such as to the tube. It may be coupled near the center, as shown, or near an end. The nipple support block includes a nipple 508 which has a hole 510 through which air passes to inflate and deflate the bladder. In one embodiment, the inside diameter of the hole is sized to provide a substantially airtight seal with the outer diameter of the air tube (not shown). In some embodiments, the inside of the hole may be provided with barbs to help retain the tube. In other embodiments, the tube may fit over the outside diameter of the nipple. In either case, the nipple may be provided with a transverse hole 512 through which a brad or pin (not shown) may be inserted to pierce the air tube and retain it.

Figure 6:
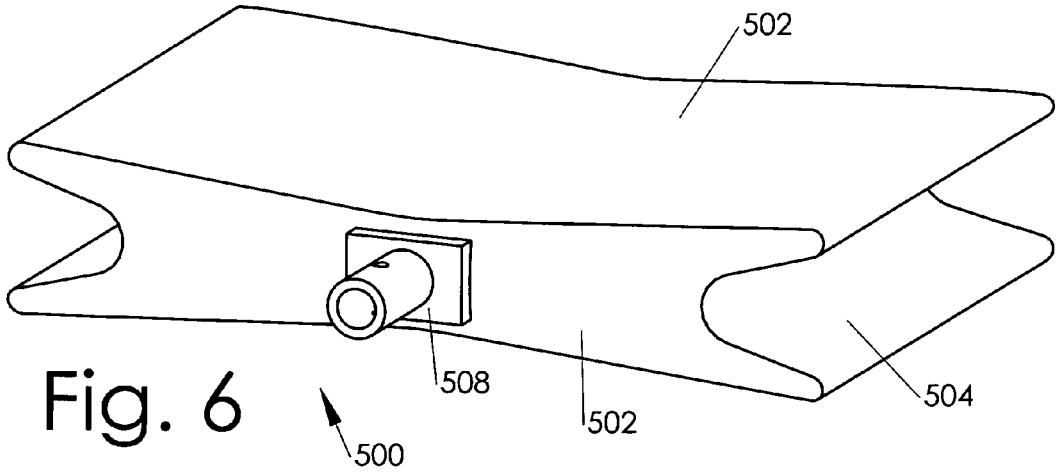

FIG. 6 illustrates the bladder 500 in a deflated condition. The cylindrical tube 502 has collapsed, and the ends 504 become deformed. The bladder generally collapses about the nipple support block 506, into a somewhat random shape dictated largely by the geometry, thickness, stiffness, and non-uniformities of the material of the bladder.

Figure 7:
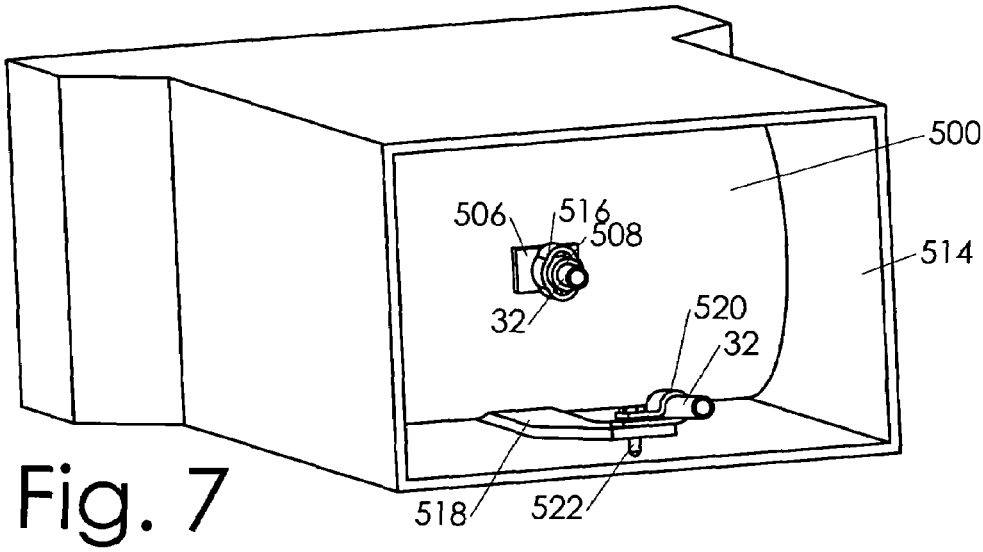
FIGS. 7 and 8 show the air bladder of FIG. 5 installed in a duct, in inflated and deflated configurations, respectively.

FIG. 7 illustrates the bladder 500 installed in a duct 514, as viewed from the back or, in other words, from the forced air side looking generally outward toward the vent opening. The air tube 32 is inserted into the nipple 508, a pin (not visible) is pressed through the transverse hole (512 in FIG. 5) and through the air tube, securing the air tube to the nipple, and a band 516 is crimped around the nipple to secure the pin in place. The pin has a smaller diameter than the inner diameter of the air tube, to permit air to pass around the pin while flowing through the tube. In some embodiments, the pin pierces through the air tube so as to pass through the inner airflow diameter of the air tube. In other embodiments, the pin pierces the air tube more tangentially, so as to pierce only the tube wall and not through to the airflow diameter. In some embodiments, the pin may pierce the nipple and air tube without the need for a pre-formed hole 512.

The air tube is secured to a rigid strap 518 by a clamp 520, which is held in position on the strap by a screw or bolt 522. The strap is secured to the duct near the outer end of the duct, and is not necessarily secured to the duct at the end visible in FIG. 7.

Figure 8:
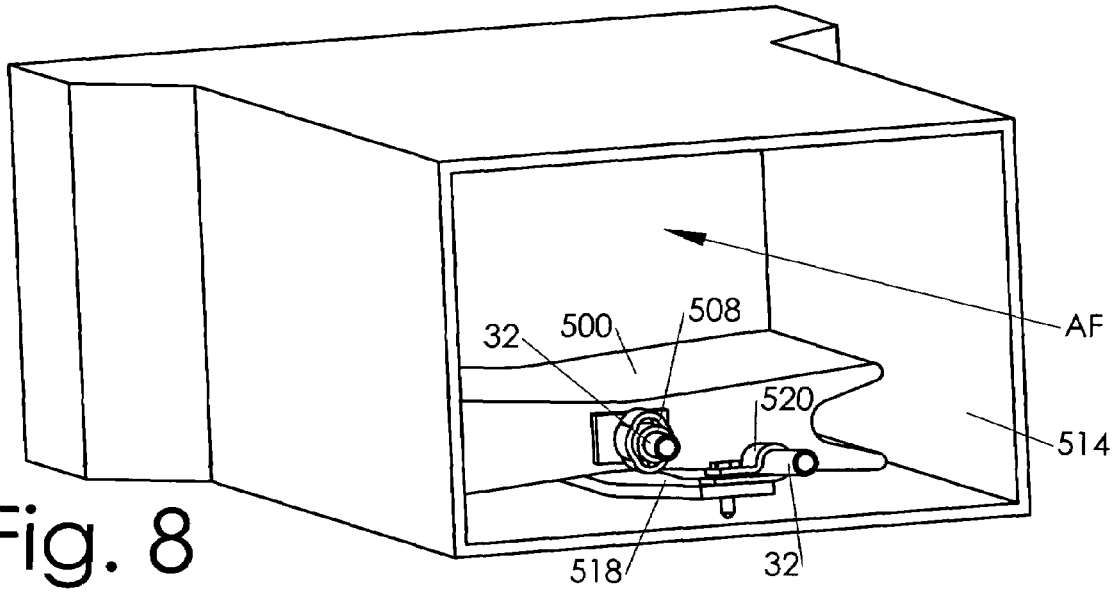

FIG. 8 shows the installation of FIG. 7 with the bladder deflated. The bladder deforms to a smaller shape, and no longer provides significant air resistance to air flowing (AF) through the duct. The bladder hangs from the segment of the air tube 32 which is fastened at one end to the nipple 508 and at the other end to the clamp 520. In some embodiments, the bladder may be equipped with springs or other means for controlling its deflated shape, if required for e.g. preventing the deflated bladder from flapping and making noise within the duct when conditioned air is flowing through the duct.

Figure 9:
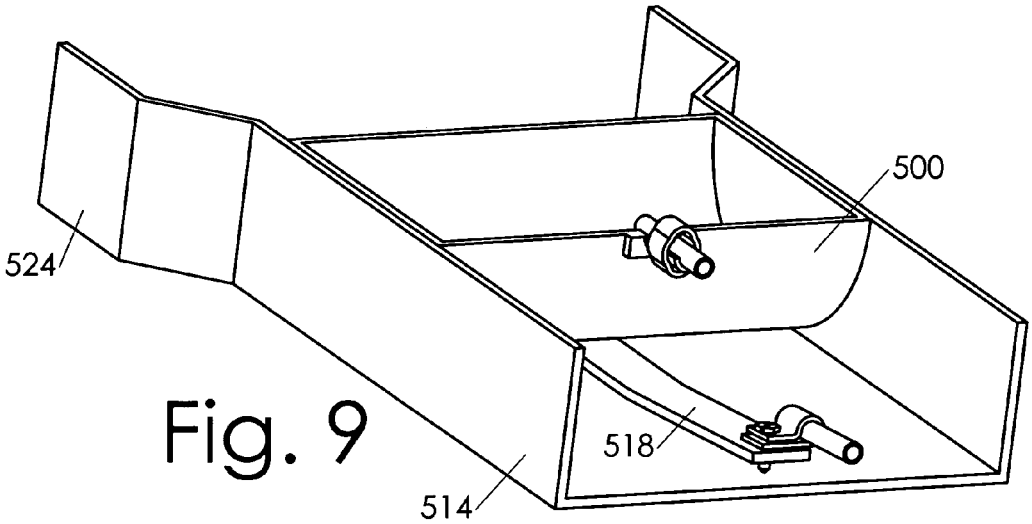
FIG. 9 shows the assembly of FIG. 7 with a cutaway through the duct and bladder for better viewing of the other parts.

FIG. 9 shows the installation of FIG. 7 as viewed generally from the other end, or the vent end of the duct 514. The duct and bladder are illustrated in cutaway fashion, to make the other components more readily visible. Typically, the bladder 500 will be installed in a position within the duct 514 itself and not within the vent 524. The strap 518 is secured to the duct by a screw 526 which can be affixed by accessing only through the open end of the vent. The other end of the strap, which is farther inside the duct, is not necessarily attached to the duct, but could be if desired.

Figure 10:
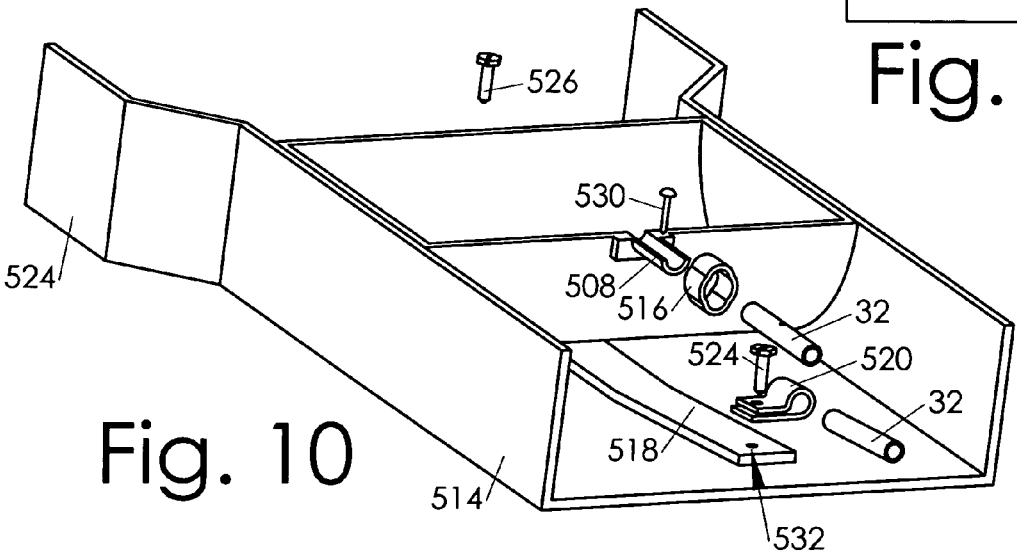
FIG. 10 is an exploded view of the assembly of FIG. 9.

FIG. 10 illustrates the installation of FIG. 9 in an exploded view. The strap 518 is secured to the duct by a screw 526, which is inserted through a hole 528 (and a corresponding hole, not visible, through the duct) which is either pre-drilled or which is formed by the (self-tapping) screw 526. The air tube 32 is inserted through a band 516 and into the nipple 508, a pin 530 is inserted through the nipple and the air tube, and the band is crimped down to secure the pin. The air tube is routed through a clamp 520 which is fastened to a hole 532 in the strap by a screw 522.

Figure 11:
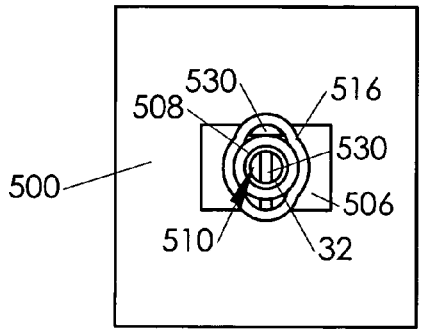
FIG. 11 shows details of the assembly.

FIG. 11 illustrates a detail close-up of the air tube attachment mechanism of FIGS. 7–10, shown as looking directly into the nipple hole 510. The nipple support block 506 is coupled to the bladder 500 or formed integrally therewith, and the nipple 506 is coupled to or integral with the support block. The air tube 32 is inserted into the nipple 508, then the pin 530 is inserted through the nipple and the air tube, leaving a portion of the airway hole 510 unobstructed. Finally, the band 516 is crimped over the pin to hold it in place. In other embodiments, duct tape or other means may be used to secure the pin.

Figure 12:
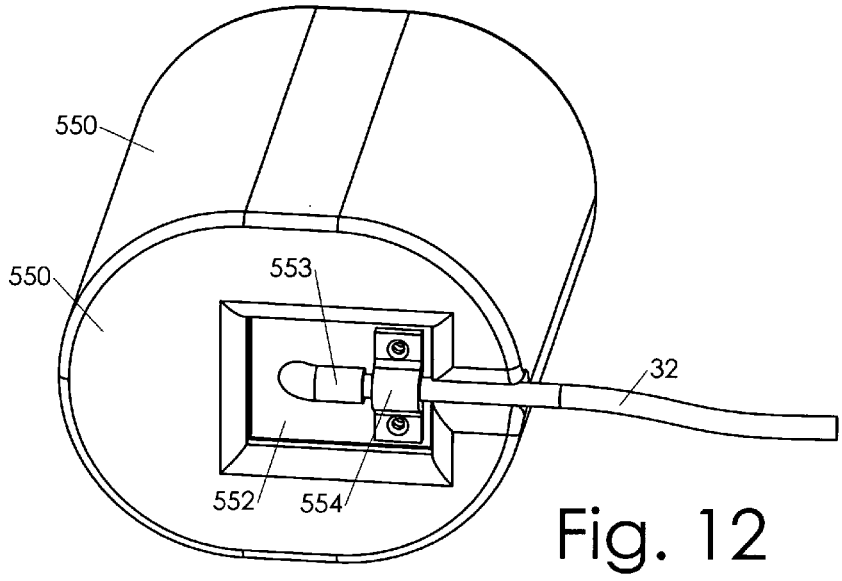
FIG. 12 shows another embodiment of a bladder according to this invention.

FIG. 12 illustrates another embodiment of a bladder. The bladder includes one or more panels 550 formed into a suitable inflatable shape. A support block 552 is coupled to one of the panels. The air tube 32 is inserted through the support block to provide pressure and vacuum for the bladder, and a retainer 554 is coupled to the support block, pinching the air tube enough to retain it without preventing airflow through it.

Figure 13:
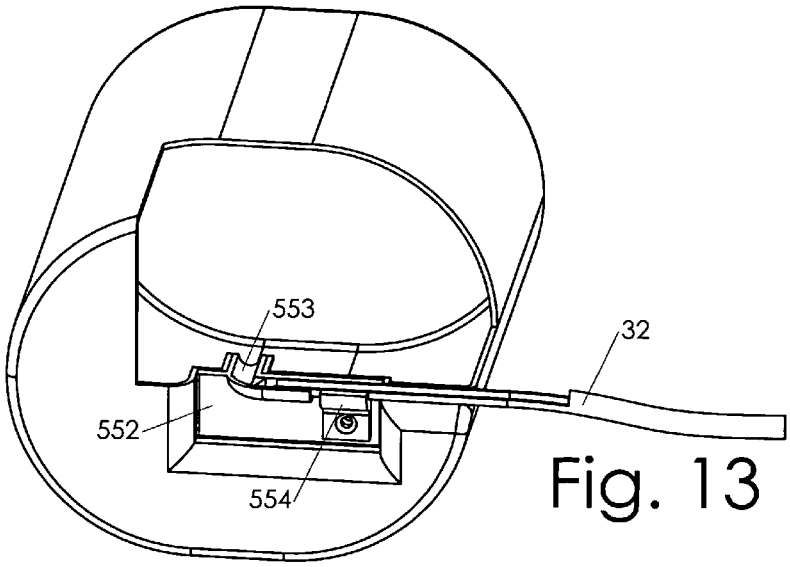
FIG. 13 shows the bladder of FIG. 12 with a cutaway.

FIG. 13 illustrates the bladder of FIG. 12 with a cutaway. The support block 554 includes barbs 556 (visible through the transparent air tube) for retaining the air tube 32. The retainer 554 is fastened to the support block by any suitable means(not shown), such as by short screws, glue, or snap-fit mechanisms.

FIG. 14 illustrates a trunk 16 which includes a vent hole 602. Conditioned air is supplied directly from the trunk, rather than from an intermediate duct. Adding zone climate control capability for this vent hole has previously been impossible or at best problematic, because the entire trunk cannot be blocked in order to prevent airflow through this one vent, as the trunk must still provide conditioned air to other trunks, ducts, and vents farther downstream from this vent.

FIG. 15 illustrates a bladder system 600 suitable for adding zone climate control capability to a vent hole 602 which is located directly on a trunk 16 which serves other trunks or vents which are not in the same zone as the vent hole 602 and which are downstream from it. The bladder system is shown with a cutaway for better visibility of its components.

A roofed passageway 604 is inserted inside the trunk, and is larger than the duct hole over which it is positioned. In some embodiments, the installation is accomplished without modification of the trunk, and by accessing only through the duct hole. In such embodiments, the roofed passageway (which is larger than the hole through which it must be inserted) may be rolled up for insertion and unrolled once inside the trunk, or it can be inserted in parts and assembled inside the trunk. In one simplistic embodiment, the roofed passageway may be fabricated from a single piece of sheet metal, and comprises a roof section, two opposing walls, and flanges at the bases of the walls for securing the structure to the trunk (by sheet metal screws inserted from below, outside the trunk). When the hole in the duct is approximately square, its diagonal is more than 1.4 times the length of its edge. If the edge dimension of the roofed passageway is less than 1.4 times the edge dimension of the hole, the roofed passageway can be rotated and manipulated so that it passes through the hole to the inside of the duct. The roofed passageway can then be reoriented to fully cover and extend over all the edges of the hole. The open ends of the roofed passageway permit airflow beneath the roofed passageway. The sheet metal could be provided with lips at the open ends, to add structural stiffness. A wide variety of other configurations are possible for the roofed passageway, such as a flat panel of corrugated aircraft flooring and four posts or legs.

A donut-shaped bladder 606 is placed beneath the roofed passageway, surrounding the vent hole. It may be held in place by any suitable means, such as the strap system detailed above, or by gluing it to the duct. In many applications, it will be found desirable to orient the bladder with its nipple 608 upstream, so the air tube extends in the direction of the plenum.

With the bladder deflated, as shown, conditioned air is free to flow between the bladder and the roofed passageway, and out the vent hole.

FIG. 16 illustrates the bladder system 600 with the bladder 606 inflated. When the bladder is inflated, it expands to make contact with the underside of the roofed passageway 604, preventing air from passing from the trunk 16 out the vent hole 602. Air remains able to flow through the trunk, however, and the bladder system effectively provides zone climate control for the vent which is located directly on the trunk (or shared duct).

Figure 17:
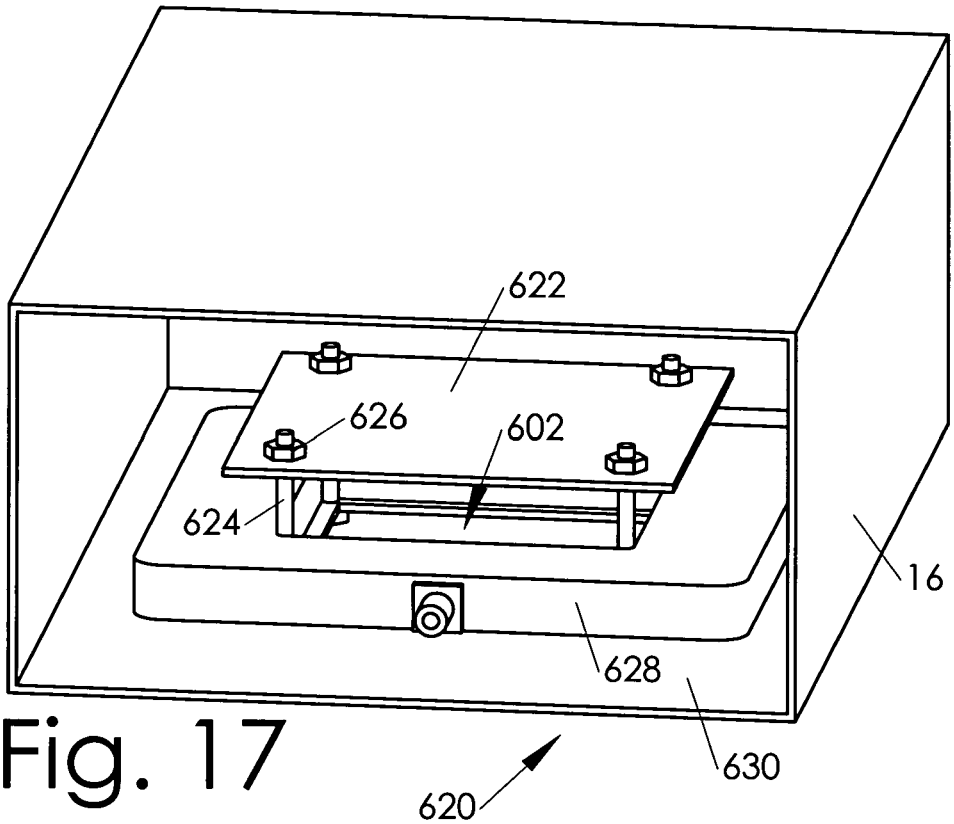
FIGS. 17 and 18 show a bladder system according to another embodiment of this invention, deflated and inflated.
Figure 18:
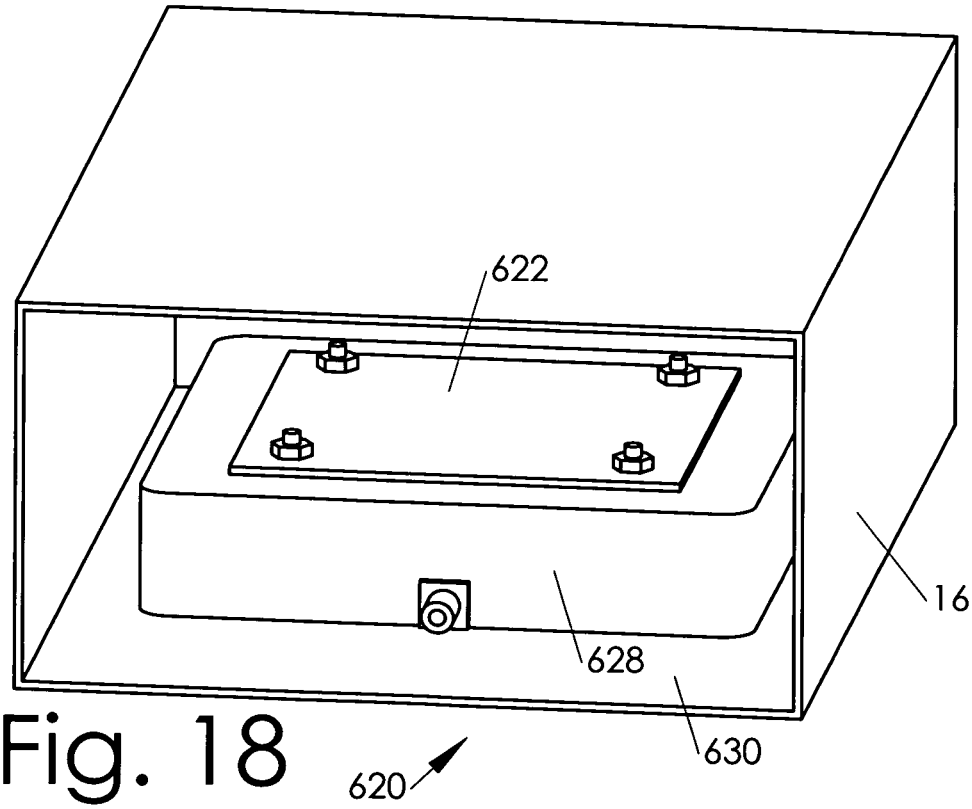

FIGS. 17 and 18 illustrate another embodiment of a bladder system 620 for adding zone climate control to a vent hole 602 located in the middle of a duct or trunk 16. A roof 622 is held in a fixed stand-off position by bolts 624 which, for ease of assembly, may couple to captive nuts 626 on the roof. The donut-shaped bladder 628 surrounds the hole, just outside the bolts. With the bladder deflated, as shown in FIG. 17, some of the air flowing through the trunk is free to exit the vent hole 602 by passing between the deflated bladder and the roof. With the bladder inflated, as shown in FIG. 18, the bladder seals against the roof and against the floor 630 of the trunk, preventing air from reaching the vent hole. In many instances, it will be possible to form the roof as a single, rigid piece which is passed through the vent hole on the diagonal and rotated into position inside the trunk. For example, if the vent hole is a five inch square, the roof may be a seven inch square, providing nearly an inch of overlap between the bladder and the outer perimeter of the roof. The bolts may be inserted through holes drilled through the trunk near the corners of the vent hole as close as practicable.

Figure 19:
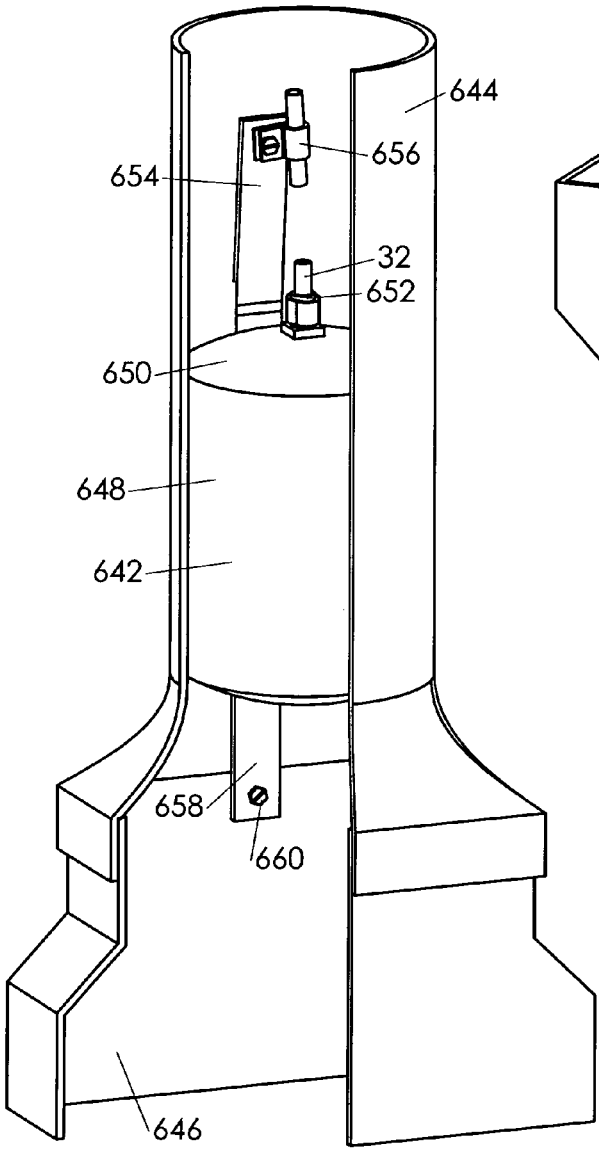
FIG. 19 shows a bladder system according to this invention, suitable for use in a vertical duct feeding a vent in a ceiling.

FIG. 19 illustrates another embodiment of a bladder system 640 suitable for hanging a bladder 642 in a generally vertical duct 644 which provides conditioned air to a vent 646 in e.g. a ceiling. The bladder is specially adapted for use in a round duct, in that it includes a cylindrical portion 648 which is in contact with the inner wall of the duct, and a pair of ends 650. The upper end includes a nipple 652 or other suitable fitting for retaining the air tube 32.

The bladder is installed by coupling the air tube to a strap 654 such as with a clamp 656, inserting the strap into the vent and duct until the bladder is suitably positioned, then fastening the lower end 658 to the vent or duct, such as with a screw 660. Ideally, the strap is long enough that the screws, clamps, and other fasteners will not touch or damage the bladder. When the bladder is deflated, it will simply hang from the air tube, which is firmly held in place by the clamp at the upper end of the strap. Gravity and the stiffness of the air tube are sufficient to keep the deflated bladder in position. The pin which pierces the air tube and the nipple provides a sufficiently strong fastening to suspend the deflated bladder.

Figure 20:
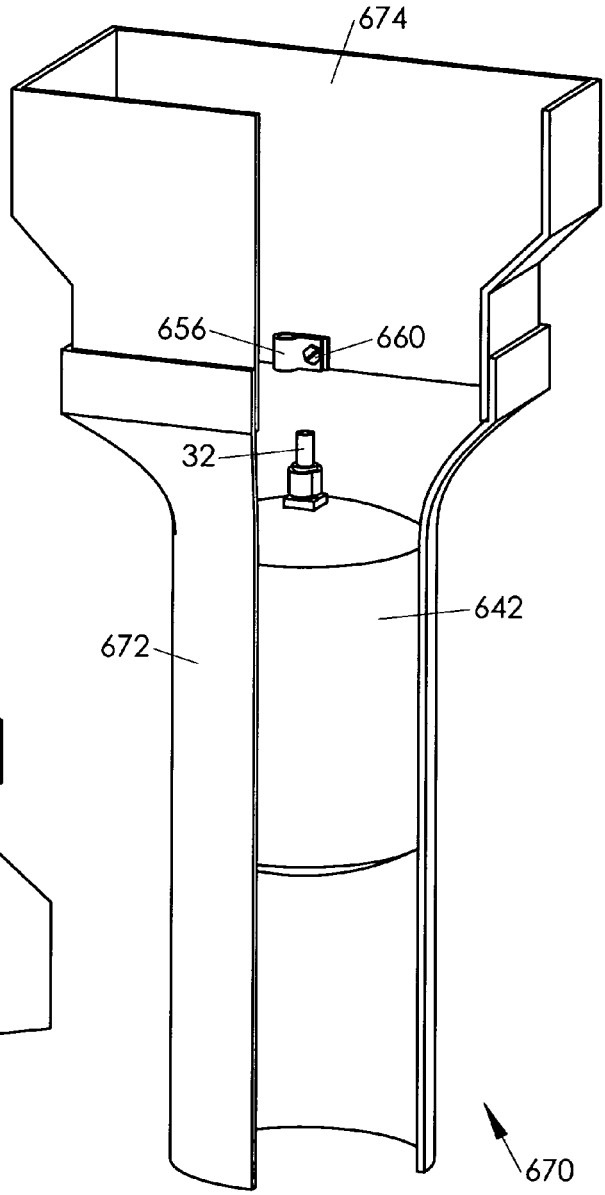
FIG. 20 shows a bladder system according to this invention, suitable for use in a vertical duct feeding a vent in a floor.

FIG. 20 illustrates another, similar embodiment of a bladder system 670 suitable for hanging the bladder 642 in a generally vertical duct 672 which provides conditioned air to a vent 674 in e.g. a floor. The air tube 32 is looped above the bladder and fastened to the vent or duct with a clamp 656 and a screw 660. When the bladder is deflated, it hangs from the piece of air tube which is between the clamp and the nipple.

Other configurations are possible, for providing zone climate control at a vent which is located directly on a trunk. For example, a short section of duct could be inserted inside the trunk, feeding only the one vent hole, and a regular (non donut) bladder could be employed within this internal duct. Such a configuration may not always be possible, as in the case of trunks or ducts which do not have a large internal height, such as those which are commonly used between floors of a multi-story dwelling, or in the case of trunks which have high airflow requirements which would be unacceptably reduced by this larger structure.

Conclusion

From the forgoing description, it will be apparent that there has been provided an improved forced-air zone climate control system for existing residential houses. Variation and modification of the described system will undoubtedly suggest themselves to those skilled in the art. Accordingly, the forgoing description should be taken as illustrative and not in a limiting sense.

When one component is said to be "adjacent" another component, it should not be interpreted to mean that there is absolutely nothing between the two components, only that they are in the order indicated. The various features illustrated in the figures may be combined in many ways, and should not be interpreted as though limited to the specific embodiments in which they were explained and shown. Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. A pneumatic bladder assembly for use as an airflow control mechanism in an HVAC system, in which an air pump selectably provides one of pressure and vacuum to an air tube extending through ductwork of the HVAC system, the pneumatic bladder assembly comprising:

an inflatable and deflatable bladder having a nipple for coupling to the air tube;

a pin piercing the nipple and the air tube, thereby securing the air tube to the nipple; and a band surrounding the nipple and the pin to prevent the pin from dislodging from the nipple.

2. The pneumatic bladder assembly of claim 1 further comprising:

a rigid strap for coupling to the ductwork and a clamp coupled to the strap, for coupling to the air tube.

3. The pneumatic bladder assembly of claim 1 wherein:

the pin pierces through an inner diameter of the air tube, wherein the pin is in contact with the pressure and vacuum.

4. The pneumatic bladder assembly of claim 1 wherein:

the bladder has a donut shape.

5. The pneumatic bladder assembly of claim 4 further comprising:

a roof, couplable to the ductwork above a vent hole in the ductwork, and surrounded by the donut shaped bladder, wherein when the bladder is inflated, the bladder seals a space between the roof and the ductwork, thereby preventing conditioned air from passing from the ductwork out the vent hole.

6. The pneumatic bladder assembly of claim 5 wherein:

the roof comprises a substantially planar member; and a plurality of bolts supporting the roof.

7. The pneumatic bladder assembly of claim 1 further comprising:

a clamp for securing the air tube to the ductwork, whereby the bladder is hung from the clamp in a substantially vertical duct.

8. The pneumatic bladder assembly of claim 1 wherein:

the pin pierces through two opposing sides of the nipple and two opposing sides of the air tube.

* * * * *